US006308348B1

(12) United States Patent
Liou

(10) Patent No.: US 6,308,348 B1
(45) Date of Patent: Oct. 30, 2001

(54) CONTINUOUS WATER LEVEL CONTROLLER

(75) Inventor: Wen-Guey Liou, No. 10, Lane 54, Sec. 3, Reh Her Rd., Taichung (TW)

(73) Assignee: Wen-Guey Liou, Taichung (TW)

( * ) Notice: Subject to any disclaimer, the term of this patent is extended or adjusted under 35 U.S.C. 154(b) by 0 days.

(21) Appl. No.: 09/692,854

(22) Filed: Oct. 19, 2000

(51) Int. Cl.[7] ..... E03D 1/34
(52) U.S. Cl. ..... 4/388; 4/378; 251/55
(58) Field of Search ..... 4/360, 378, 379, 4/380, 388; 251/36, 47, 55

(56) References Cited

U.S. PATENT DOCUMENTS 1,220,856 * 3/1917 Keating ..... 4/378 X
1,568,346 * 1/1926 Ryan ..... 4/388
3,376,013 * 4/1968 Mallett ..... 251/55
3,404,703 * 10/1968 Marx ..... 251/55
3,820,171 * 6/1974 Larson ..... 4/360

FOREIGN PATENT DOCUMENTS

16047 * 5/1915 (GB) ..... 4/388

* cited by examiner

*Primary Examiner*—Robert M. Fetsuga
(74) *Attorney, Agent, or Firm*—Kolisch Hartwell Dickinson, McCormack & Heuser

(57) ABSTRACT

A continuous water level controller includes a base member, a sleeve mounted in the base member, a piston assembly and an actuating linkage. A stopper is attached to one end of the shaft in the base member to close the outlet of the base member. A piston is slidably received in said sleeve and securely attached to the shaft. A spring is mounted around the shaft between the stopper and the piston. The time the outlet is open is controlled by the restitution force of the spring and the siphonage between the piston and the sleeve. Consequently, the distance the piston travels controls the volume discharged from the outlet to achieve the goal of continuous control.

5 Claims, 4 Drawing Sheets

CONTINUOUS WATER LEVEL CONTROLLER

BACKGROUND OF THE INVENTION

1. Field of the Invention

The present invention relates to a water level controller, and more particularly to a continuous water level controller.

2. Description of Related Art

A conventional toilet bowl has no water level controller mounted in the tank. Every time the flush handle is pushed, all the water in the tank flows into the toilet bowl no matter how much water is needed. Consequently, a lot of water is wasted. In response for the need to conserve water, a two-step water level controller was invented. The conventional two-step water level controller cannot be used conveniently because it must adapt to be used with a water tank. Furthermore, the two-step water level controller cannot be used with a urinal.

The present invention has arisen to mitigate and/or obviate the disadvantages of the conventional toilet bowl.

SUMMARY OF THE INVENTION

In accordance with one aspect of the present invention, a continuous water level controller includes a base member, a sleeve mounted in the base member and a shaft extending through the sleeve. A stopper is attached to one end of the shaft in the base member to close the outlet of the base member. A piston is slidably received in said sleeve and securely attached to the shaft. A spring is mounted around the shaft between the stopper and the piston. The restitution force of the spring and the siphonage between the piston and the sleeve controls the time the outlet is open.

Further benefits and advantages of the present invention will become apparent after a careful reading of the detailed description with appropriate reference to the accompanying drawings.

DESCRIPTION OF THE DRAWINGS

Figure 1:
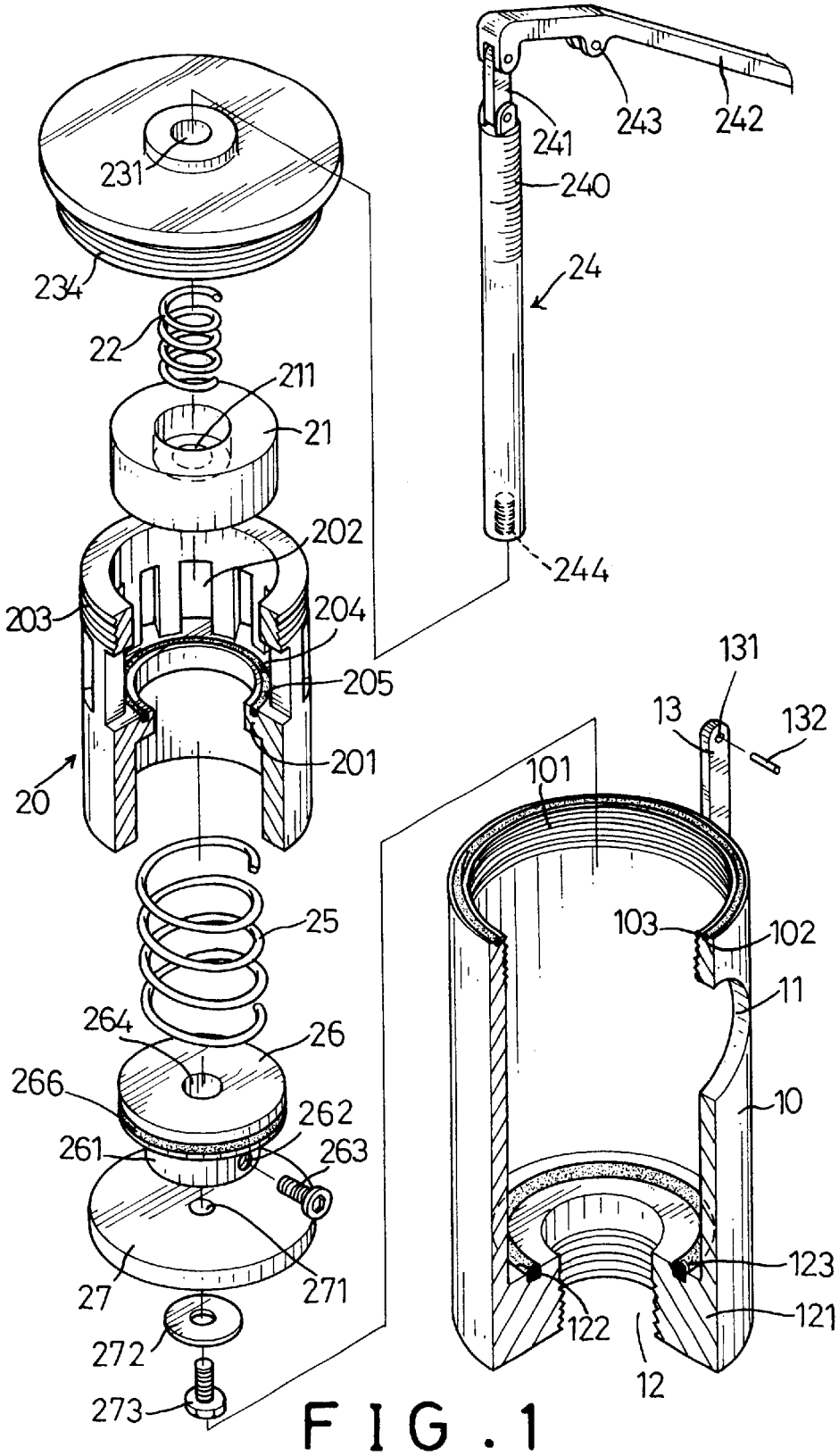
FIG. 1 is an exploded perspective view of a continuous water level controller in accordance with the present invention.
Figure 2:
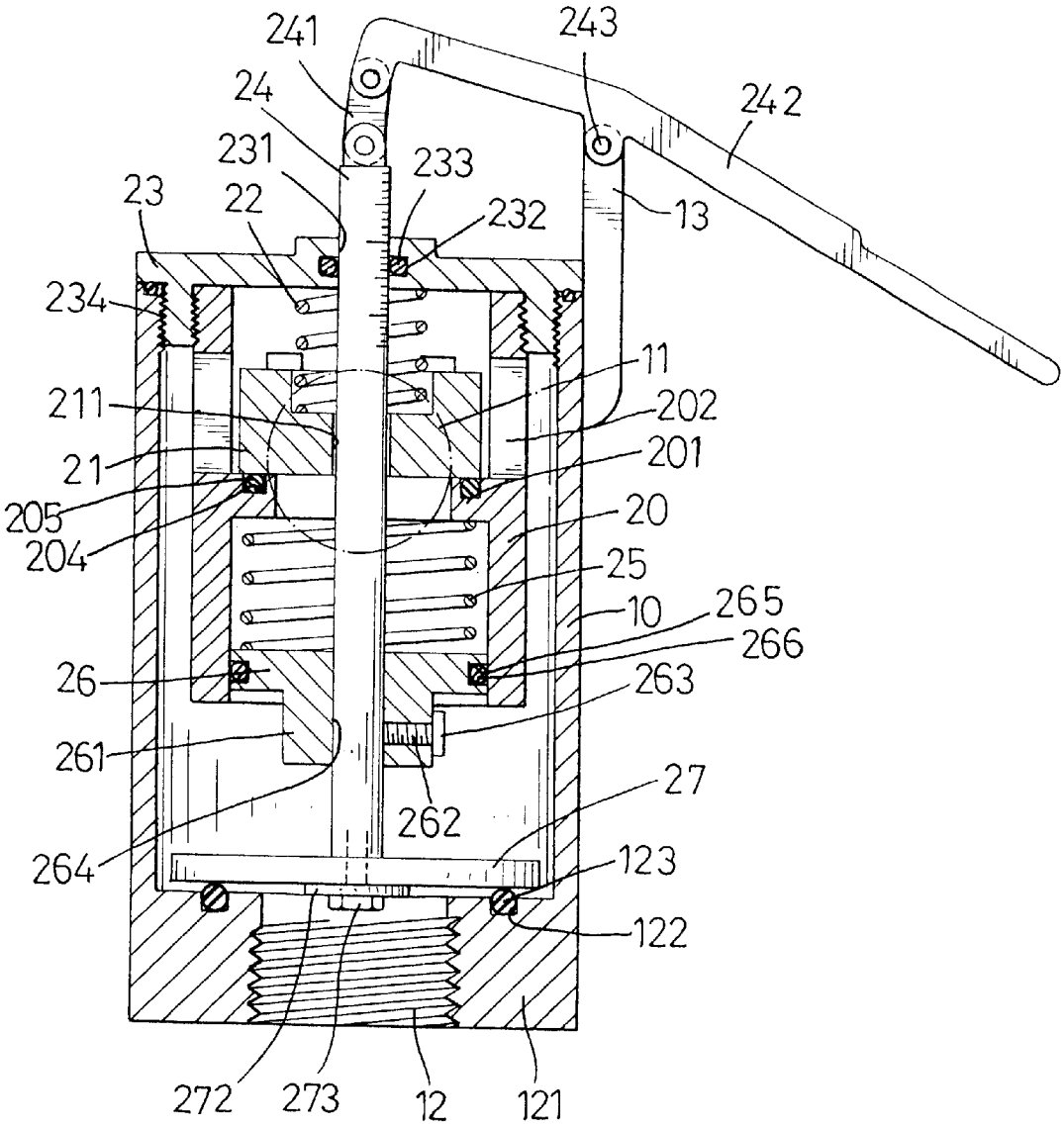
FIG. 2 is a cross sectional side plan view of the continuous water level controller in FIG. 1.
Figure 3:
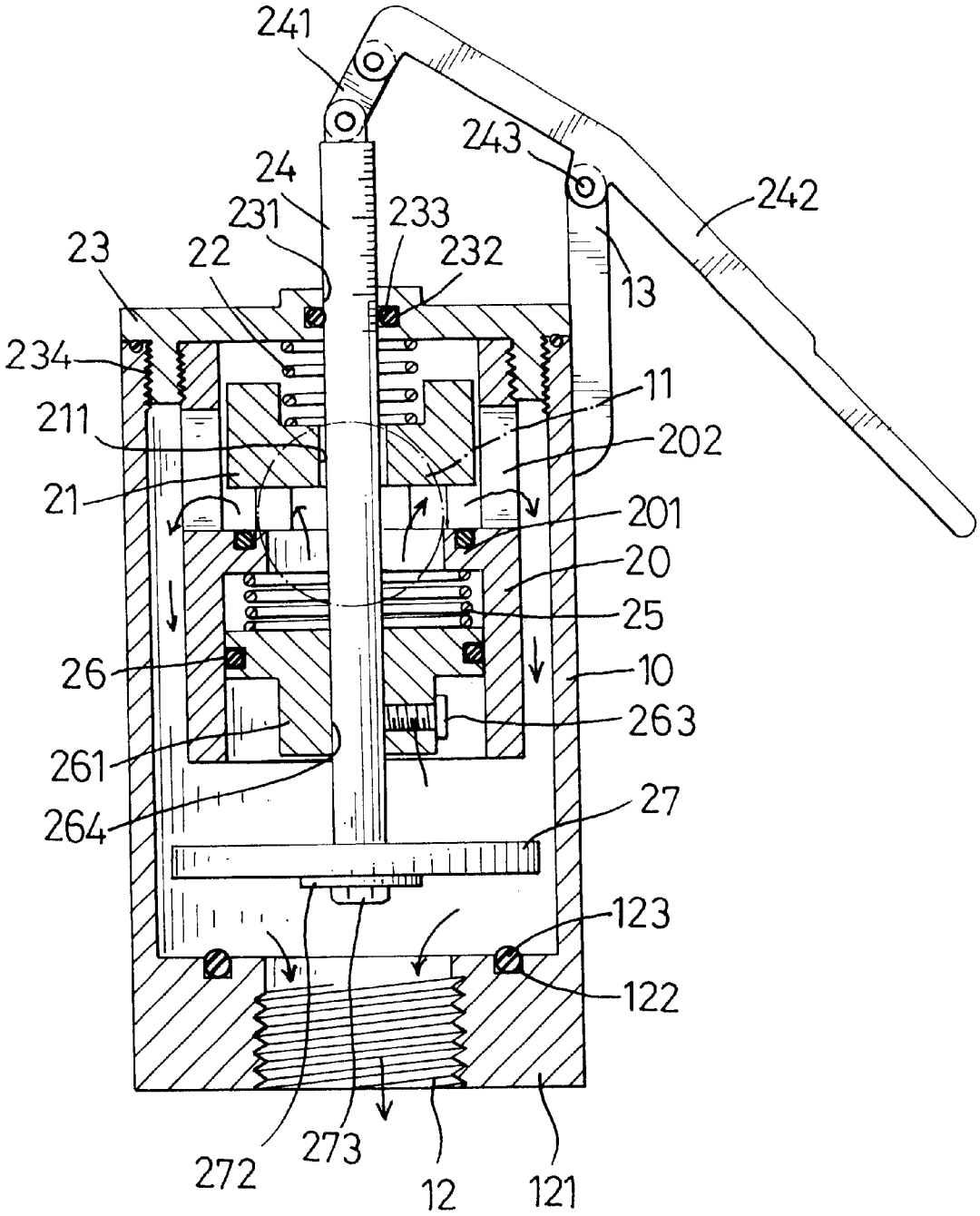
FIG. 3 is a cross sectional side plan view of the continuous water level controller in FIG. 1 when the outlet of the present invention is open.
Figure 4:
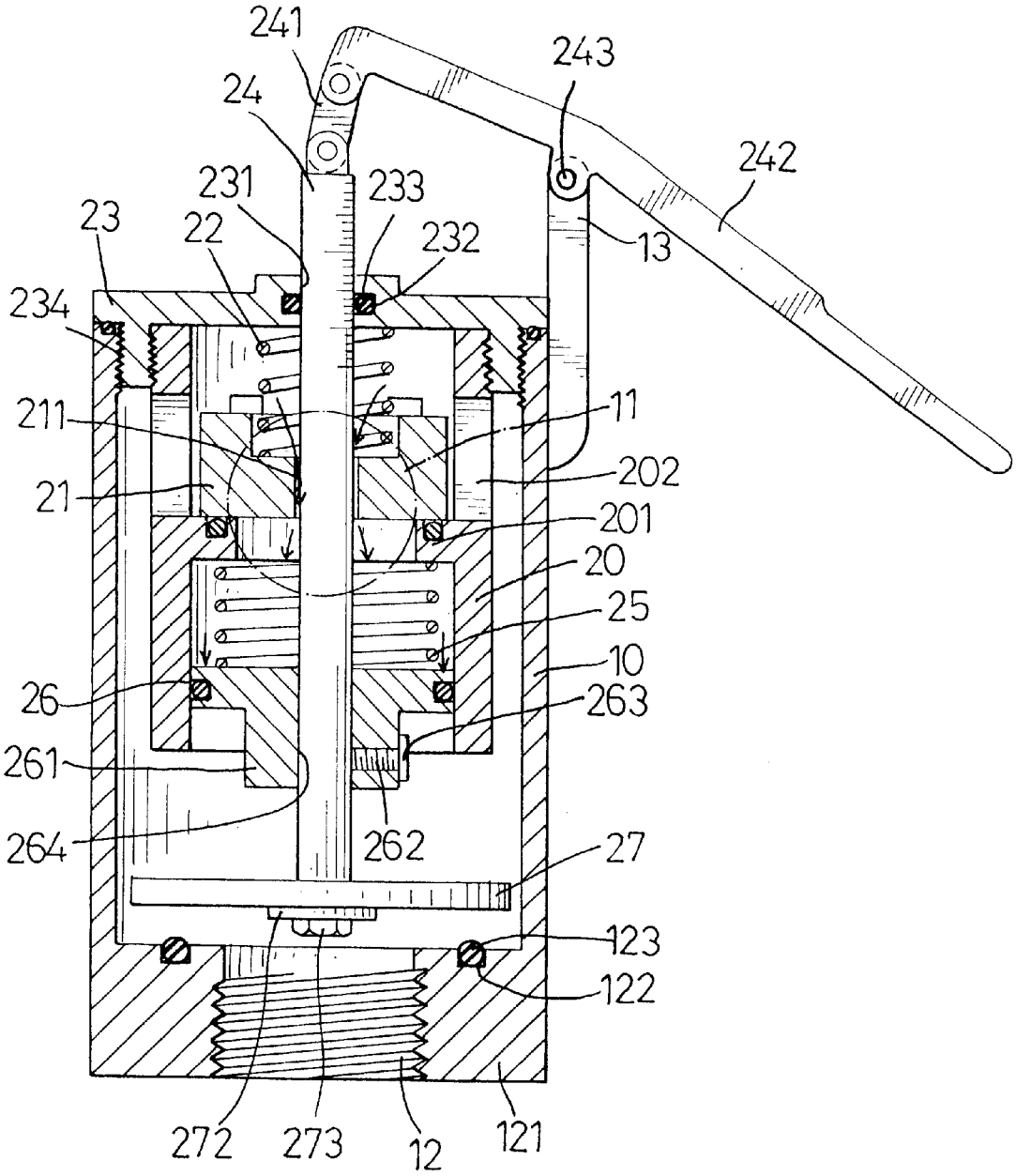
FIG. 4 is a cross sectional side plan view of the continuous water level controller in FIG. 1 when the outlet of the present invention is gradually closed.

Referring to the drawings and initially to FIGS. 1–2, a continuous water level controller in accordance with the present invention comprises a tubular base member (10) a piston assembly and an actuating linkage.

The tubular base member (10) has a female thread (101) formed on a first end and a shoulder (121) extending radially inward formed on a second end. An outlet (12) surrounded by the shoulder (121) is defined in the second end of the base member (10). The shoulder (121) forms a plane (not numbered) facing the first end of the base member (10). An annular groove (122) is defined in the plane of the shoulder (121) to receive an O-ring (123). An inlet (11) is defined in and extends through the side of the base member (10). An annular groove (102) is defined face of the wall of the base member (10) to receive an O-ring (103). A cover (23) is attached to the first end of the base member (10) and securely abuts the O-ring (103) in the annular groove (102) at the first end of the base member (10) to seal the base member (10). The side of the cover (23) facing the base member (10) has an annular flange (234) to extend into the base member (10). A male thread (not numbered) is formed on the external surface of the flange (234) and screws into the female thread (101) at the first end of the base member (10). A female thread (not numbered) is formed on the internal surface of the flange (234). A hole (231) aligned with the central axis of the base member (10) is defined in the cover (23). An annular groove (232) is defined in the internal surface of the hole (231) to receive an O-ring (233). A vertical fulcrum bar (13) is attached to the first end of the base member (10) and has a hole (131) defined in the free end.

A sleeve (20) is mounted in the base member (10) and includes an annular flange (201) extending radially inwardly near the middle portion. An external male thread (203) is formed on the end of the sleeve (20) corresponding to the first end of the base member (10). The male thread (203) screws into the thread on the inside of the annular flange (234) on the bottom of the cover (23). Multiple slots (202) are defined in and penetrate the sidewall of the sleeve (20) between the male thread (203) and the annular flange (201). The side of the flange (201) near the slots (202) has an annular groove (204) defined to receive an O-ring (205).

A block (21) is slidably mounted in the sleeve (20) and abuts the O-ring (205) received in the annular groove (204) defined in the annular flange (201) of the sleeve (20). A counter sunk through hole (211) is defined in the center of the block (21) to correspond to the hole (231) in the cover (23).

A first spring (22) is compressively mounted in the counter sunk through hole (211) between the cover (23) and the block (21).

A piston assembly comprising a piston (26), a spring (25) and a stopper is mounted in the sleeve (20). The piston (26) slides in the sleeve (20) below the annular flange (201) in the sleeve (20) and forms a chamber in the sleeve (20) with the block (21) closing the other end of the chamber. The piston (26) has a diameter only slightly smaller than the inside diameter of the sleeve (20). A through hole (264) aligning with the through hole (211) in the block (21) and the hole (231) in the cover (23) is defined in the center of the piston (26). An annular groove (265) is defined in the outside face of the piston (26) to mount a wearing ring (266). The wearing ring (266) abuts the internal sidewall of the sleeve (20). A stub (261) integrally formed with the piston (26) extends towards the outlet (12). A threaded hole (262) is radially defined in the stub (261) and communicates with the through hole (264) of the piston (26).

The second spring (25) is compressively mounted between the piston (26) and the annular flange (201) of the sleeve (20).

The stopper (27) is mounted in the base member (10) between the piston (26) and the shoulder (121) at the end of the base member (10) to close the outlet (12). A through hole (271) aligned with the through hole (264) in the piston (26), the through hole (211) in the block (21) and the hole (231) in the cover is defined in the center of the stopper (217). The stopper (27) has a diameter big enough so that the bottom face of the stopper (27) will press against the O-ring (123) in the annular groove (122) in the shoulder (121) at the bottom of the base member (10). The stopper (27) is held against the O-ring (123) by the restitution force of the second spring (25) to fully close the outlet (12).

The actuating linkage comprises a shaft (24), a lever (242) and a connecting link (241). The shaft (24) extends through the cover (23), the first spring (22), the block (21), the sleeve (20), the second spring (25) and the piston (26). A first end of the shaft extends out from the cover (23). A setscrew (263) screws into the threaded hole (262) in the piston (26) to press against the shaft (24) to hold the piston (26) in place on the shaft (24) ein the sleeve (20). As shown in FIG. 1, the setscrew (263) is a bolt. A threaded hole (244) is defined in the second end of the shaft (24). A bolt (273) passes through the through hole (271) in the stopper (27) and screws into the threaded hole (244) in the shaft (24) to hold the stopper (27) in place. The shaft (24) has a diameter which is slightly smaller than that of the O-ring (233) received in the annular groove (232) of the base member (10) and smaller than that of the through hole (211) of the block (21) to form a gap. A connecting link (241) pivotally connects to the first end of the shaft (24) extending out from the cover (23). The section of the shaft (24) slides in the cover (23) and has a scale (240) etched or printed on the periphery.

The lever (242) is pivotally mounted on the free end of the fulcrum bar (13). A pair of ears (not numbered) are formed on the middle portion of the lever (242). Each ear contains a pivot hole (243) aligning with the hole (131) of the fulcrum bar (13). Apivot pin (132) passes through the pivot holes (243) and the hole (131) in the fulcrum bar (13) to hold the lever (242) in place. One end of the lever (242) corresponds to the first end of the shaft (24) and is attached to the free end of the connecting link (241).

When the water level controller is at rest, the base member (10) is fill of water. As used in a toilet, the water between the piston (26) and the block (21) is squeezed to push the block (21) up and flows through the slots (202) when depressing the lever (242) to lift up the shaft (24). The block (21) moves back to abut the O-ring (205) received in the annular groove (204) of the sleeve (20) at once due to the restitution force of the first spring (22). At the same time, the stopper (27) is lifted up to open the outlet (12) and the water flows from the outlet (12) to the toilet bowl until the outlet (12) is closed again by the stopper (27). The stopper (27) cannot return to close the outlet (12) until the water flows into the chamber between the block (21) and the piston (26) because the wearing ring (266) on the piston (26) slides on the internal periphery of the sleeve (20).

As described, the time the outlet (12) open is lengthened. Therefore, the distance the piston (26) moves controls how long the outlet (12) is open and the amount of water discharged from the outlet (12) to achieve the goal of continuous control. The user further can refer to the scale (240) defined on the shaft (24) to adjust the volume of water that is discharged from the outlet (12).

Although the invention has been explained in relation to its preferred embodiment, it is to be understood that many other possible modifications and variations can be made without departing from the spirit and scope of the invention as hereinafter claimed.

What is claimed is:

1. A continuous water level controller comprising:

a tubular base member including a first end having an outlet defined with a shoulder extending inward and a second end, said base member including an inlet defined in and extending through a periphery;

a sleeve mounted in said base member and including an annular flange extending inward from a internal periphery and near a middle portion of said sleeve, said sleeve including multiple slots defined in and extending through the periphery between said annular flange and said first end of said base member;

a block slidably received in said sleeve and abutting one side of said annular flange toward said first end of said base member, said block including a centrally defined through hole;

a cover attached to said first end of said base member to seal said second of said base member, said cover including a centrally defined hole aligning with said through hole of said block;

a first spring mounted between said block and cover;

a shaft slidably received in and extending through said hole of said cover, said first spring and said through hole of said block, said shaft having a second end extending out from said sleeve toward said outlet and a first end extending out from said cover, said shaft and said block forming a gap;

a piston penetrated by said shaft, securely attached to said shaft and slidably received in said sleeve under said annular flange of said sleeve, a second spring mounted between said annular flange of said sleeve and said piston and penetrated by said shaft; and a stopper attached to said second end of said shaft, said stopper closing said outlet of said base member in a rest position due to the force of restitution of said second spring.

2. The continuous water level controller as claimed in claim 1, wherein said base member includes:

a fulcrum bar attached to a periphery of said base member, said fulcrum bar having a hole defined in a free end;

a connecting link pivotally attached to said first end of said shaft;

a lever pivotally mounted on said free end of said fulcrum, said lever having one end of said lever pivotally connected to a free end of said connecting link and a middle portion having a pivot hole defined to align with said hole of said fulcrum bar; and a pivot pin extending through said hole of said fulcrum bar and said pivot holes of said lever to pivot said lever on said fulcrum bar.

3. The continuous water level controller as claimed in claim 1, wherein said shaft includes scale formed on a periphery corresponding to said cover.

4. The continuous water level controller as claimed in claim 1, wherein said first spring has a restitution force smaller than that of said second spring.

5. The continuous water level controller as claimed in claim 1, wherein said piston integrally includes a stub extending toward said outlet, said stub having a radial threaded hole defined to be parallel to said piston, a setscrew screwed into said threaded hole and pressing against said shaft to securely hold said piston in place.

* * * * *